US010239184B2

(12) United States Patent
Axinte et al.

(10) Patent No.: US 10,239,184 B2
(45) Date of Patent: Mar. 26, 2019

(54) ABRADING TOOL FOR A ROTARY DRESSER

(71) Applicant: ROLLS-ROYCE PLC, London (GB)

(72) Inventors: Dragos Axinte, Nottingham (GB); Donka Novovic, Birmingham (GB); Paul Butler-Smith, Nottingham (GB); Alessio Spampinato, Nottingham (GB); Mark Daine, Nottingham (GB)

(73) Assignee: ROLLS-ROYCE plc, Derby (GB)

( * ) Notice: Subject to any disclaimer, the term of this patent is extended or adjusted under 35 U.S.C. 154(b) by 219 days.

(21) Appl. No.: 15/054,690

(22) Filed: Feb. 26, 2016

(65) Prior Publication Data

US 2016/0271752 A1 Sep. 22, 2016

(30) Foreign Application Priority Data

Mar. 20, 2015 (GB) ..... 1504759.0

(51) Int. Cl.

| | |
|---|---|
| ***B24D 5/06*** | (2006.01) |
| ***B24D 5/14*** | (2006.01) |
| ***B24B 53/06*** | (2006.01) |
| ***B24B 53/07*** | (2006.01) |
| ***B24B 53/14*** | (2006.01) |
| ***B24D 18/00*** | (2006.01) |

(Continued)

(52) U.S. Cl.

CPC ..... *B24B 53/14* (2013.01); *B24D 3/00* (2013.01); *B24D 5/066* (2013.01); *B24D 5/14* (2013.01); *B24D 18/0045* (2013.01); *B24B 53/053* (2013.01); *B24B 53/062* (2013.01); *B24B 53/07* (2013.01)

(58) Field of Classification Search

CPC ..... B24B 53/017; B24B 53/02; B24B 53/04; B24B 53/047; B24B 53/053; B24B 53/06; B24B 53/062; B24B 53/07; B24B 53/14; B24D 18/0045

See application file for complete search history.

(56) References Cited

U.S. PATENT DOCUMENTS 1,256,167 A * 2/1918 Ross ..... B24B 53/14 125/37
1,912,069 A * 5/1933 Doermann ..... B24D 5/066 451/510

(Continued)

FOREIGN PATENT DOCUMENTS

DE 2438487 A1 2/1976
DE 3920473 C1 1/1991

(Continued)

OTHER PUBLICATIONS

Sep. 10, 2015 Search Report issued in British Patent Application No. 1504759.0.

*Primary Examiner* — Timothy V Eley
(74) *Attorney, Agent, or Firm* — Oliff PLC

(57) ABSTRACT

A roller assembly for a rotary dresser comprise a plurality of axial segments which may be in the form of discs, each disc provided with an abrasive, radially outer surface. The discs are secured in axial alignment, each in a preconfigured rotational orientation. The disc assembly has a centrally arranged aperture for receiving a rotor shaft. The abrasive surface of the assembly can be accurately presented as an array of uniformly shaped abrasive units in a predefined pattern.

24 Claims, 8 Drawing Sheets

(51) Int. Cl.
*B24B 53/053* (2006.01)
*B24D 3/00* (2006.01)

(56) References Cited

U.S. PATENT DOCUMENTS 1,984,936 A * 12/1934 Larsson ..... B24D 5/066 451/246
1,990,927 A * 2/1935 Beth ..... B24D 5/066 451/544
2,084,513 A * 6/1937 Tone ..... B24D 5/06 451/542
2,594,137 A * 4/1952 Doermann ..... B24D 5/066 451/544
3,067,551 A * 12/1962 Maginnis ..... B24D 5/14 451/49
3,537,216 A * 11/1970 Borgh ..... B24B 1/00 451/58
3,802,130 A * 4/1974 Lindenbeck ..... B24D 5/14 451/544
3,827,422 A * 8/1974 Wise ..... B24B 53/14 125/37
4,131,436 A * 12/1978 Wiand ..... B24D 5/14 51/295
6,827,641 B2 * 12/2004 Yoshida ..... B24D 5/066 451/541
7,241,206 B1 * 7/2007 Sung ..... B24B 7/228 451/527
9,381,618 B2 * 7/2016 Kaul ..... B24D 5/066
9,486,895 B2 * 11/2016 Mueller ..... B24D 5/02
2011/0065369 A1 * 3/2011 Henn ..... B24D 5/066 451/548
2012/0108153 A1 * 5/2012 Sakakibara ..... B24B 53/14 451/443
2012/0171935 A1 * 7/2012 Ruland ..... B24B 53/017 451/56
2012/0302146 A1 11/2012 Sung
2014/0187129 A1 * 7/2014 Sivasubramanian .... B24D 3/04 451/541
2014/0302757 A1 * 10/2014 Inamori ..... B24B 53/12 451/443
2015/0343542 A1 * 12/2015 Dunda ..... B23D 63/123 451/543
2016/0074993 A1 * 3/2016 Smith ..... B24B 53/017 451/443

FOREIGN PATENT DOCUMENTS

EP 1346797 B1 11/2006
EP 2447005 A2 5/2012

* cited by examiner

5a

5b
Section A-A

ABRADING TOOL FOR A ROTARY DRESSER

The present disclosure concerns a novel design of rotary dresser of the sort typically used in the truing and dressing of grinding wheels and other abrasive cutting and machine tools.

Rotary dressers are extensively used to regenerate or form the abrasive surfaces of grinding wheels and other tools to provide or restore the required tool profile. Dressing of grinding tools is crucial when these tools are to be used in the machining of profiles with tight tolerances and small radii.

A typical rotary dresser comprises a rotor shaft to which is mounted a concentrically arranged roller tool which is provided with an abrasive radially outer surface. The radially outer surface can be accurately profiled to reflect the form of the component to be ground. The abrasive surface can be made up of multiple abrasive grains bonded to the surface. Synthetic diamond grains are commonly used, although it is also known to use naturally occurring diamond grains.

Examples of diamond rotary dressers are described in prior published patent applications numbers EP2447005 A2, EP1346797 B1 and US2012/0302146. These prior publications seek to address the problem of random grain distribution which can result in accelerated wear and obstruct debris flow across the surface during operation of the dresser. These documents propose controlled positioning and bonding of abrasive grains to a roller surface to achieve a more uniform load and improved debris flow. The time consuming and expensive methods proposed require intricate placing of the grains about the surface. Such methods are not a practical solution where the rotary dresser is required for truing and dressing tools with very small radii and tight tolerances.

According to a first aspect of the invention there is provided a roller assembly for a rotary dresser comprising a plurality of discs, each disc provided with an abrasive, radially outer surface, the discs secured in axial alignment, each in a preconfigured rotational orientation and a centrally arranged aperture for receiving a rotor shaft and wherein the radially outer surface of one or more discs has been subjected to a process of material removal whereby to form a pre-defined pattern of individual abrasive units.

The assembly may comprise the entire roller for the rotary dresser, or in the alternative, the assembly may comprise at least one disc provided with an abrasive, radially outer surface which has been subjected to a process of material removal whereby to form a pre-defined pattern of individual abrasive units, the discs(s) secured in axial alignment with at least one roller portion having an arrangement of abrasive grains about its radially outer surface, the disc having a finer grained abrasive surface than the one or more roller portions. In such a hybrid assembly, the abrasive surface of the disc can provide improved dressing in areas of tighter tolerance or smaller radius on the tool to be dressed.

The abrasive material of the radially outer surface of the disc comprises one or more super-abrasive materials and can be provided in a layer on the surface. The main disc body may comprise a non-abrasive material. Alternatively, the disc may comprise entirely of the abrasive material. Synthesised diamond is one suitable abrasive material and may be employed in the form of polycrystalline diamond, or CVD deposited diamond. A suitable alternative is PCBN (polycrystalline cubic boron nitride). Different discs may be provided with different abrasive materials. Any one disc may be provided with a combination of abrasive materials. Specific disc material(s) for any disc surfaces may be defined as a function of the requirements of the grinding wheel to be dressed. For example, less wear resistant abrasives could be employed to dress surface regions of the grinding wheel with lower service demands.

The abrasive surface of each disc can be patterned according to end user requirements. The discs in the assembly may share the same pattern or have different patterns.

A desired pattern can be achieved using an energy beam ablation process. Such processes are known to be a fast and efficient means to pattern solid diamond structures. Alternative methods for patterning include energy beam sputtering (i.e. focus ion beam). Such sputtering methods have particular use in achieving greater feature resolution of defined (cutting) edges. In one example, the invention uses a pulsed laser ablation technique.

The described techniques for material removal enable individual abrasive units of defined shape, size and protrusion to be formed and their locations to be accurately controlled. Profiling of individual abrasive units can be controlled at microscopic resolutions.

Population distribution of the abrasive units can also be adapted to suit the specific characteristics of the wheel to be dressed. The population distribution can be defined as a function of the grinding wheel characteristics, such as its profile, roughness and machining tolerances it is required to achieve.

A higher surface density of units is well suited to dressing tight radii on the wheel. Conversely, lower surface densities are well suited to dressing surface regions with smooth radii and plain profiles. By combining together discs with different abrasive population distributions, the dressing operation can be controlled to achieve consistent and optimal results.

The 3D characteristics of the abrasive units can be individually defined to suit defined actions, directions and rotations desired of the roller assembly. Using laser ablation methods, either or both the rake angle ($\gamma$) and clearance angle ($\alpha$) of a unit can be defined. In more complex arrangements, a combination of primary and secondary rake angles and primary and secondary clearance angles can be defined. Asymmetric units can be defined allowing the unit to perform a different dressing action depending on the direction of disc rotation.

The abrasive units on adjacent discs can be aligned so as to realise a series of channels in between the discs allowing a coolant to be delivered through the dresser, allowing a reduction of the maximum surface temperature reached during a dressing operation.

One simple arrangement involves equally spaced rows of equally spaced abrasive units extending around the radially outer surface. Alternate rows may be offset from each other. Such an arrangement is well suited to dressing a cylindrical component.

The disc diameters may be the same or different. Suitable arrangement of discs of different diameter can provide a radial surface to the assembly which is non-linear in an axial direction. The assembly can be configured to allow the removal and replacement of discs for repair, or to adapt the assembly for different dressing applications. The thickness of the discs may be the same or different.

The discs can be provided with multiple holes arranged at equal radii from the centre of the disc. With their respective holes aligned, multiple discs can be threaded onto multiple pins thereby preventing rotation of the discs relative to each other.

In another aspect of the invention, the discs can be made up of multiple disc segments. Conveniently, the segments can comprise equally sized arcuate portions. Each segment can have two or more spaced apart holes which can be threaded onto pins as described above. The pins can be received and secured in flanges at either end of the multiple disc assembly thereby holding the segments in circumferential and axial alignment.

PCD discs and disc segments are already available for purchase for other applications. Commercially available discs typically comprise a cemented carbide substrate incorporating a solvent metal catalyst, typically cobalt. A layer of micron synthetic diamond powder is provided on the radially outer surface and the disc sintered under extreme pressure and temperature and the catalyst migrates to the synthetic layer encouraging the formation of a polycrystalline structure.

Alignment holes can be machined into the discs. The discs can be sourced with an evenly distributed layer of PCD on the radial outer surface. Using the described ablation methods, material can be removed from the PCD surface in a pre-defined pattern leaving an arrangement of radially protruding, abrasive units in a pre-defined pattern. The ablated discs are thus adapted for use in a roller assembly in accordance with the present invention.

Thus, by controlling the abrasive unit characteristics (i.e. size, shape, protrusion and position) using the contemplated methods, the efficiency of the dressing process can be improved and the wear rates on tight profiles can be controlled and thus minimized.

The stacked disc configuration of the proposed roller assembly provides great flexibility. By the simple interchange of one or more discs in the assembly, a variety of abrasive patterns suited to a variety of specific dressing applications can be achieved. Worn or broken discs, or even disc segments can be easily replaced without the need to replace the entire roller tool of the rotary dresser. Where there is low wear on an abrasive surface of a disc, the abrasive pattern can be regenerated using the contemplated ablation techniques.

In another aspect of the invention, there is provided a roller for a rotary dresser, the roller provided with an abrasive, radially outer surface onto which axial segments are defined wherein the radially outer surface of the roller has been subjected to a process of material removal whereby to form a pre-defined pattern of individual abrasive units on each defined axial segment. The pre-defined pattern may be different for different axially defined segments whereby to address different dressing needs and tool wear rates at different axial positions along the roller. The roller may have a non-linear profile. The skilled addressee will understand that the methods for providing the abrasive units and the features of the abrasive unit geometries and patterns described elsewhere in this specification in relation to individual disc abrasive surfaces can equally be applied to the abrasive surfaces of defined axial segments of embodiments of this aspect of the invention. Thus, adjacent segments may be provided with different geometry abrasive units, different surface densities of abrasive units and/or different patterns of abrasive units.

One known method of ablation is laser ablation. Use of this method to define the textured pattern on the abrasive surface enables precise texturing with the ability to generate specifically designed abrasive units of identical size, shape and protrusion from the tool's surface. Size and shape of the abrasive units can be controlled at a microscopic level.

Whilst laser ablation is a very convenient method for providing the abrasive patterns described, alternative methods are possible, for example and without limitation; electrical discharge machining (EDM), laser scribing or laser lapping. Controlled chemical deposition of abrasive material onto a substrate surface in a pre-defined pattern as an alternative is also contemplated.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
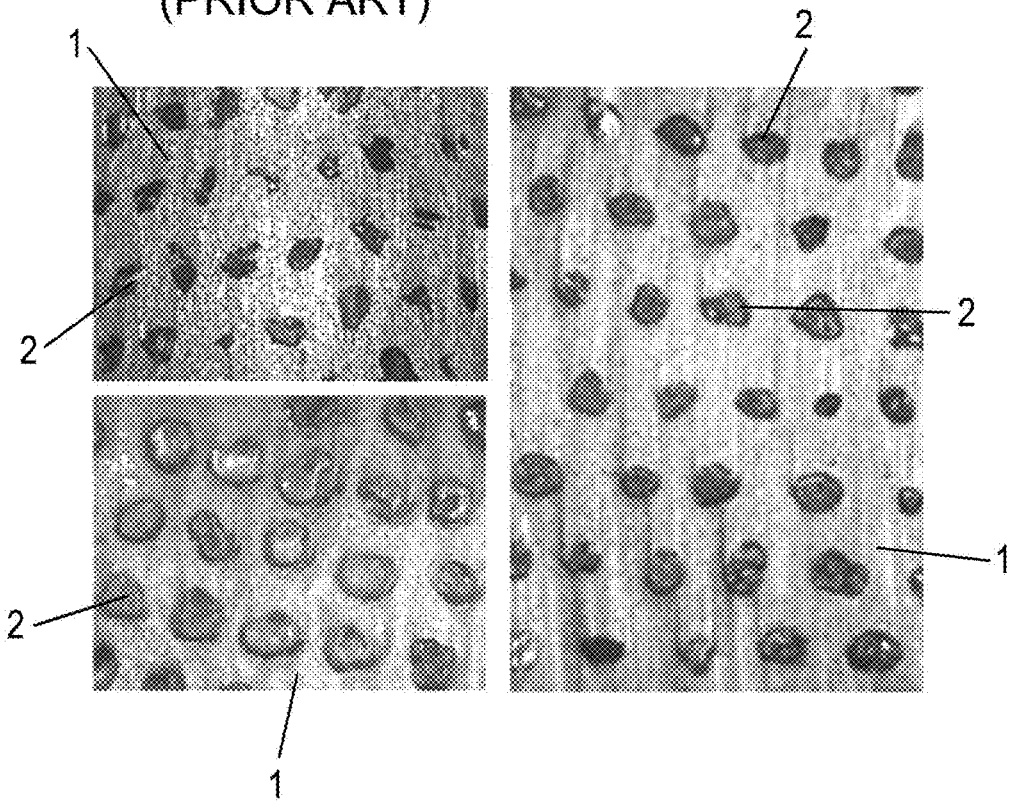
Fig.1 (PRIOR ART)
FIG. 1 shows three examples of a roller surface of a rotary dresser as known in the prior art.

As can be seen in FIG. 1, an outer surface of a dresser roller 1 is impregnated with carefully placed individual abrasive grains 2. Whilst the position and surface density of the individual grains 2 has been carefully selected, the individual grains 2 are of varying shape, size and radial protrusion, thus, at a high resolution the surface pattern is non uniform. Such an arrangement is not suited to dressing of high precision components and in particular those with small radii and tight tolerances where dresser wear is increased.

Figure 2:
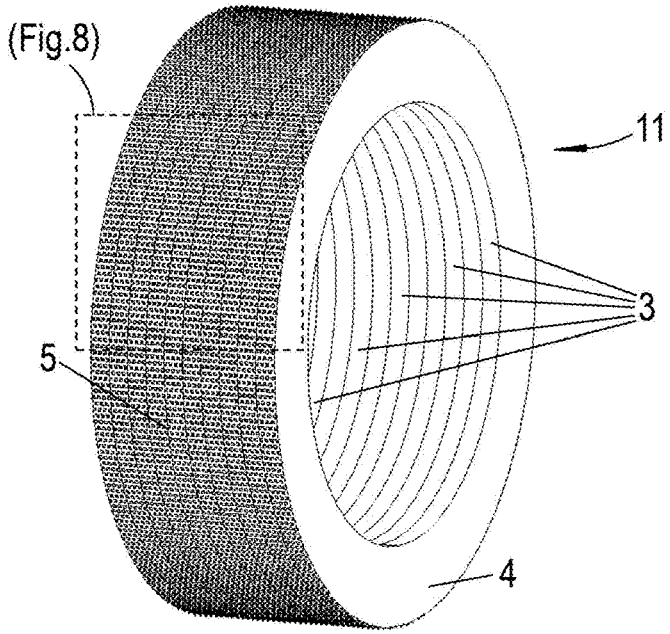
FIG. 2 shows a first embodiment of a roller assembly in accordance with the invention.

FIG. 2 shows an assembly of discs for use in a roller assembly in accordance with a first embodiment of the invention. As can be seen, the assembly (generally designated 11), comprises multiple discs 3 arranged in axial alignment to form an assembly having an axially facing surface 4 and a radially outer surface 5. The radially outer surface 5 is provided with a pattern of abrasive units shown in more detail in FIG. 8.

Figure 3:
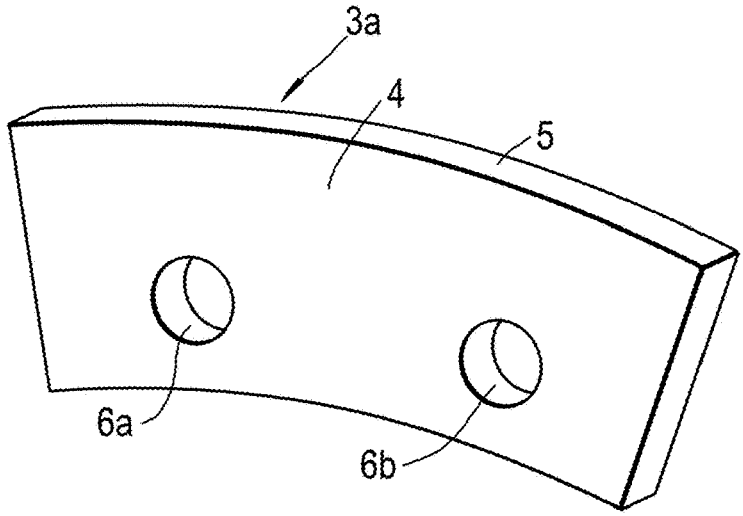
FIG. 3 shows a segment of a disc suited to use in a roller assembly in accordance with the invention.

FIG. 3 shows a disc segment generally designated 3*a*, a plurality of which can be assembled into a disc 3 for incorporation into a roller assembly in accordance with the invention. The arcuate disc segment has an axially facing surface 4 and a radially outer surface 5 (for simplicity, detail of the abrasive surface is not shown). A pair of symmetrically arranged holes 6*a*, 6*b* passes through the segment 3*a* for receiving locking pins (not shown).

Figure 4:
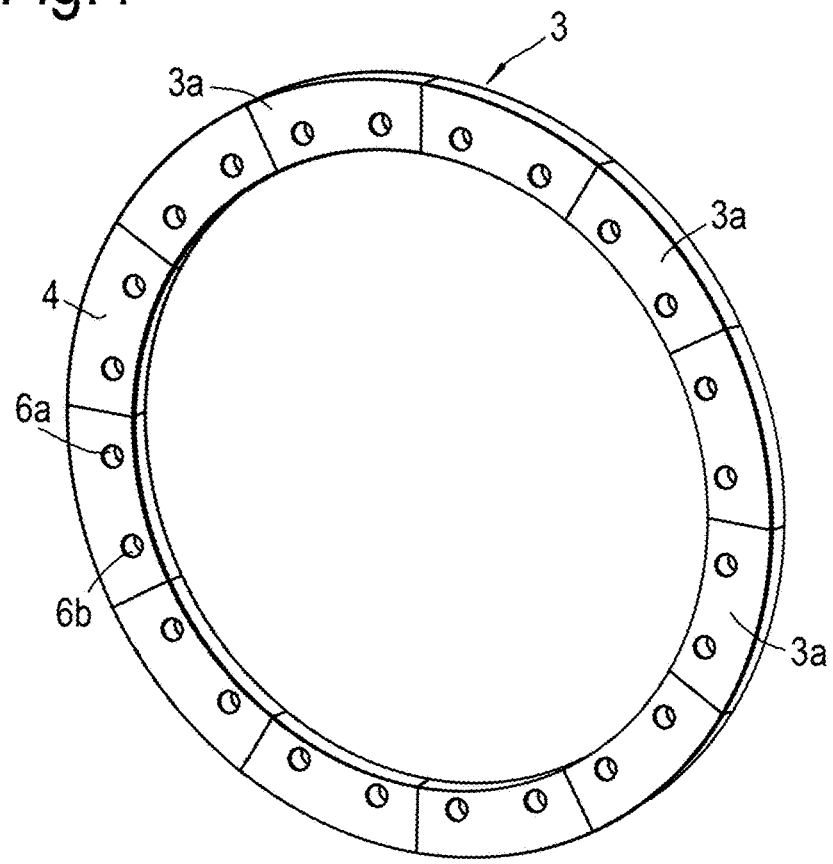
FIG. 4 shows a disc assembled from a plurality of segments similar to those of FIG. 3.

FIG. 4 shows a disc 3 assembled from 12 substantially identical disc segments 3*a* each having the construction as shown in FIG. 3. As can be seen, the pairs of holes 6*a*, 6*b* are symmetrically arranged at equal radial distances from the axis, in the axially facing surface 4.

Figure 5:
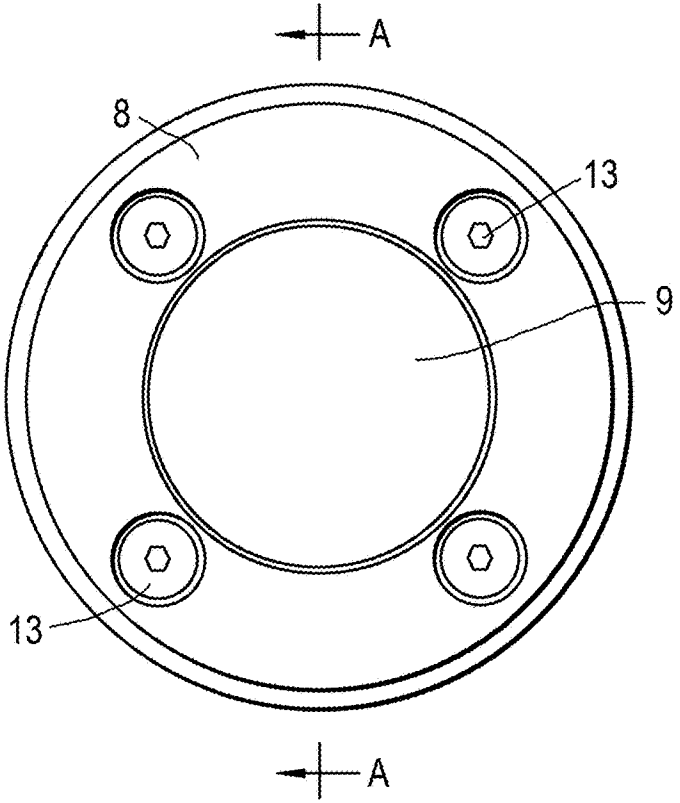
FIG. 5 shows an axial view (5*a*) and orthogonal section (5*b*) of a roller assembly in accordance with an embodiment of the invention.
Figure 5:
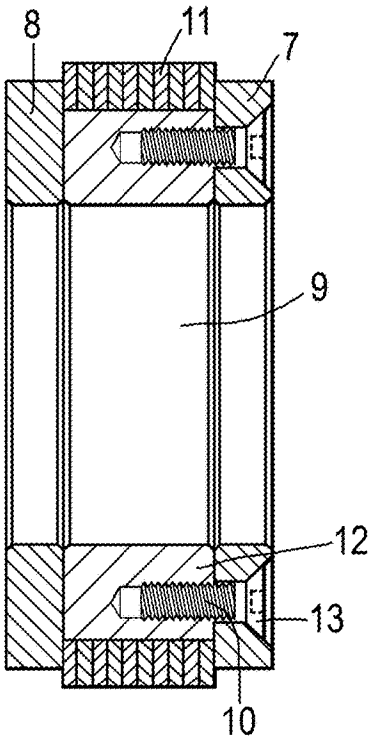

FIG. 5 shows a disc assembly 11 fastened to a hub 12 which has a bore 9 for mounting on a rotor shaft (not shown). The disc assembly 11 sits on the radially outer surface of the hub 12. The hub 12 is sandwiched between two flanges 7 and 8 which hold the discs in assembly 11 together along an axial direction. The hub 12 has tapped holes 10 for receiving screws 13 which pass through correspondingly aligned holes in the flanges 7 and 8 to secure the assembled parts of the roller assembly.

Figure 6:
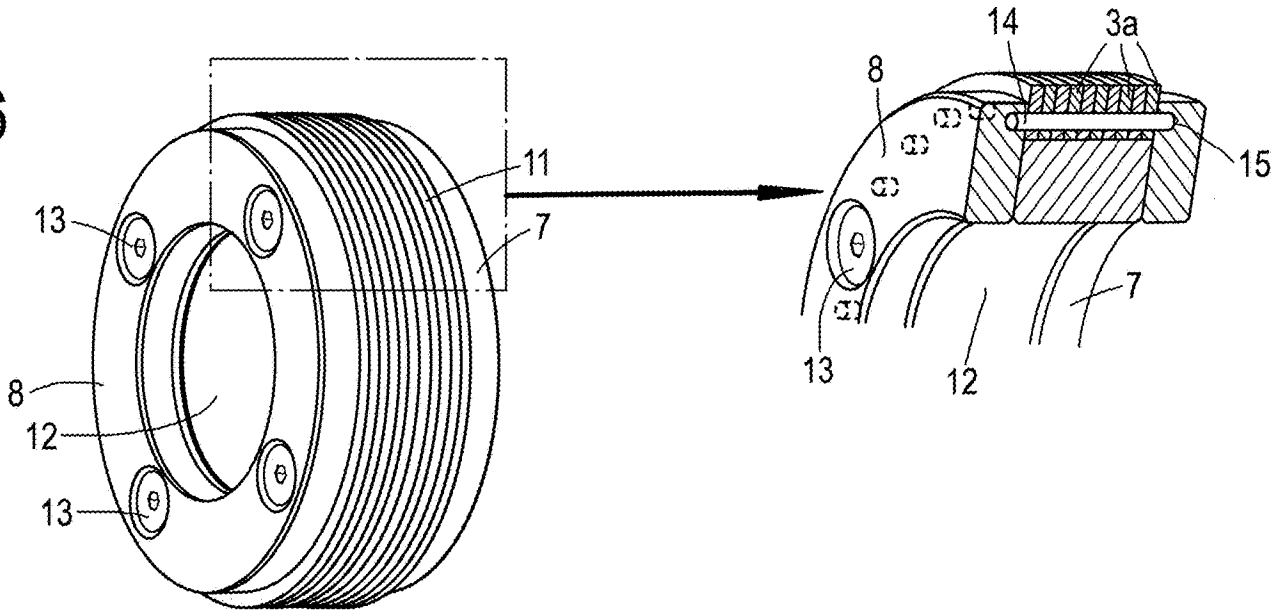
FIG. 6 shows a perspective view and a magnified sectional view of a roller assembly in accordance with an embodiment of the invention.

FIG. 6 shows in perspective view, an embodiment of a roller assembly in accordance with the present invention. The assembly is broadly similar to that shown in FIG. 5. In FIG. 6, the discs in disc assembly 11 are made up from disc segments 3*a*, substantially of the form already shown in FIGS. 3 and 4. As can be seen, the flanges 7 and 8 are provided with symmetrically arranged and axially aligned recesses 15 which in turn are axially aligned with holes 6*a* and 6*b* of the disc segments 3*a*. Pins 14 are passed through the holes 6*a*, 6*b* and received in the aligned recesses 15 of flanges 7 and 8. As for the embodiment of FIG. 5, the flanges 7 and 8 are in turn fastened to the hub 12 by means of screw 13 to provide a complete roller assembly which can be fastened to a rotor shaft (not shown). It will be apparent to the skilled reader that in other embodiments a similar arrangement of flanges, recesses, holes and pins could be used to secure an assembly of complete discs as well as the segmented discs shown in the Figure.

Figure 7:
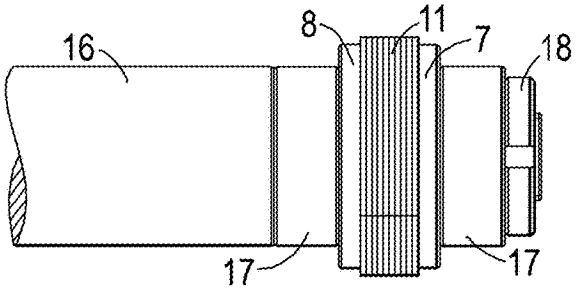
FIG. 7 shows a roller assembly in accordance with an embodiment of the invention in situ, in a dresser.

FIG. 7 shows an embodiment of a roller assembly 7, 8, 11 in accordance with the invention secured to a rotor shaft 16. The assembly 7, 8, 11 is secured between a pair of axially aligned spacers 17 and locked into position on the shaft 16 by means of locking nut 18. This fastening arrangement 16, 17, 18 is of conventional design.

Figure 8:
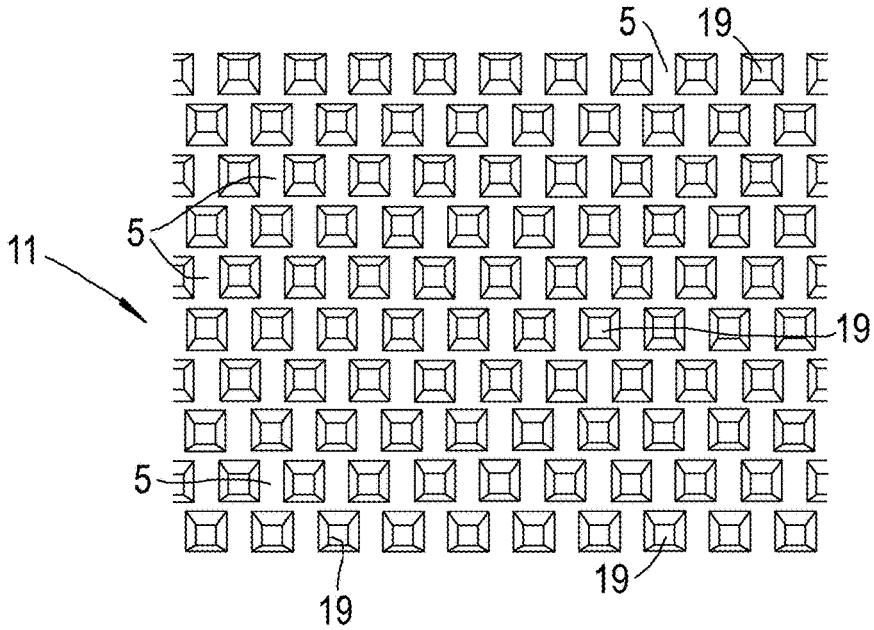
FIG. 8 shows two examples of shapes and patterns/arrangements of abrasive units on a roller assembly to provide a specific spacing in accordance with an embodiment of the invention.
Figure 8:
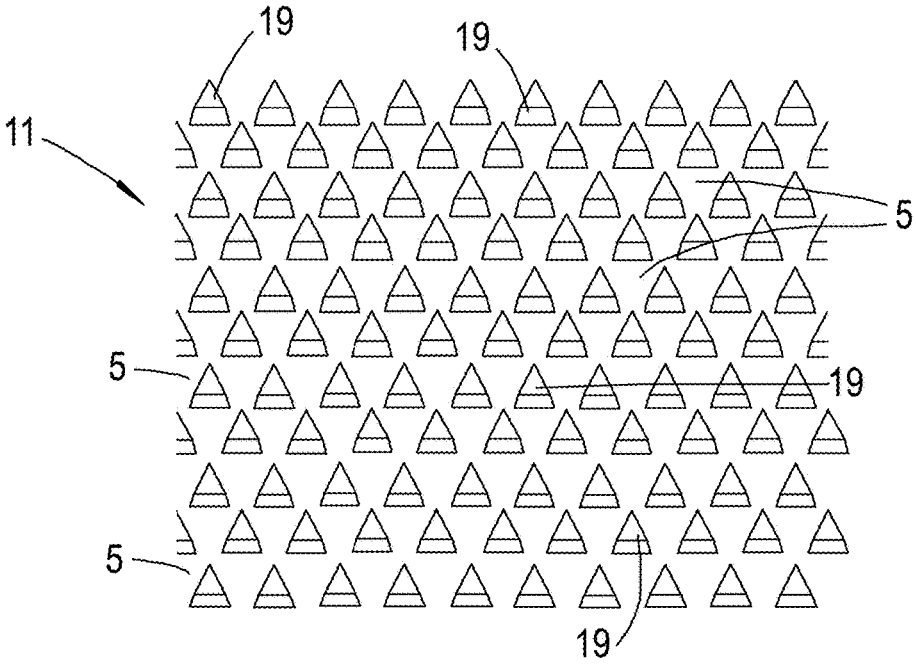

FIG. 8 shows magnified views of two different embodiments of disc assembly 11. On the radially outer surface 5 of each disc is a pattern of abrasive units 19. As previously discussed, the pattern can be cut into the surface 5 using conventional laser ablation techniques. The pattern shown is suited to a dresser roller for dressing a cylindrical grinding wheel. As can be seen, the abrasive units 19 are of a uniform shape and size and are aligned in rows with the units 19 equally spaced. Alternate rows are slightly offset such that a unit 19 from one row sits above the space between abrasive units 19 on adjacent rows. Also, spacing between the individual rows is equal and uniform around the circumference of the assembly 11. The uniformity of shape, size and protrusion of the abrasive units 19 and their orderly arrangement across the aligned surfaces 5 results in a very even dressing operation and even wear of the roller assembly. The channels defined between adjacent rows allow for effective control of debris flow and/or can be used for delivery of a cooling fluid during operation. As can be seen, in order to achieve a staggered pattern across the discs radially outer abrasive surface, some abrasive units are split across the interface between two adjacent discs.

Figure 9:
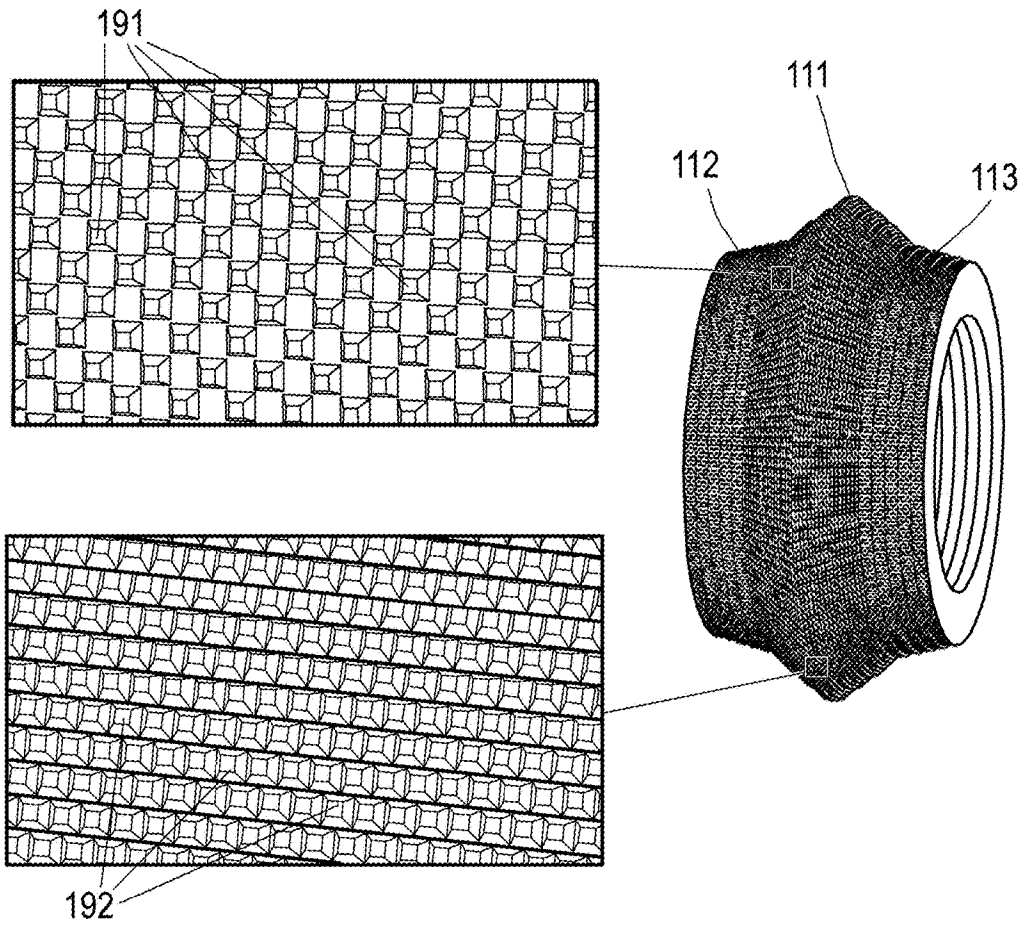
FIG. 9 shows a roller assembly in accordance with an embodiment of the invention.

FIG. 9 shows another embodiment of a disc assembly suitable for use in a roller assembly in accordance with the invention. The assembly comprises 3 main sections, each made up of multiple discs. Centre section 111 comprises multiple discs of different diameter. The largest diameter discs sit at the centre; further discs are arranged in descending order of diameter, symmetrically to either side of the centre discs providing a tapered circumferential profile. Sections 112 and 113 extend symmetrically from either side of the centre section 111. Again, the discs making up the sections 112 and 113 are arranged in descending order of diameter with the smallest diameter discs at the axially facing ends of the assembly. As can be seen, the reduction in the diameters for discs of sections 112 and 113 is less extreme than for section 111 resulting in a more gradually declining surface. It will be understood from the geometry of the assembly that a roller assembly incorporating this disc assembly is suited to dressing a grinding wheel with a circumferential dip at the centre of its radially outer surface. As is reflected by the profile of section 111, the radii to the centre of the dip are very tight. The profile to either side of the dip is relatively smooth with a much gentler change in radii across the surface.

The boxes to the left of the disc assembly show magnified views of the surfaces of the discs in sections 112 and 111. Whilst not shown, it will be understood that the disc section 113 will have a surface which is essentially a mirror image of that of section 112.

In section 112 (and 113), the abrasive units 191 are of a uniform size, shape and radial protrusion and are evenly distributed in a chequerboard pattern across the surface of the section.

Section 111 which is configured to tru and dress tight radii is provided with a very densely packed pattern of abrasive units 192. As is the case for the arrangement shown in FIG. 8, the units 192 are of a uniform size, shape and radial protrusion. They are aligned in rows, as in FIG. 8 and on section 112, but the gap between units and adjacent rows is much smaller. This densely packed arrangement of abrasive units allows better control of accuracy of dressing on the tight radii surface.

As can be seen, the abrasive units 191 and 192 are cut to the shape of truncated, quadrilateral pyramid. This arrangement permits dense packing of the units on the radial surface (which are near touching in section 111) whilst still providing channels between the units closer to the radially outer, truncated surfaces of the units for the passage of debris and/or effective delivery of a cooling fluid.

As mentioned above, in another aspect, the discs may be replaced by axially defined segments of a roller which may have a similar profile to the roller assembly shown and into which a similar pattern of abrasive units may be applied.

Figure 10:
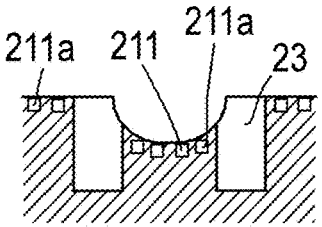
FIG. 10 shows a roller assembly in accordance with another embodiment of the invention.

FIG. 10 shows an alternative embodiment of the invention. The roller assembly shown comprises a roller portion 211 into the radially outer surface of which are embedded multiple abrasive grains 211*a*. Also embedded into the radially outer surface of the roller portion are two discs 23, substantially of the form already described. The discs have an abrasive radially outer surface of abrasive units which are significantly smaller in size than the individual abrasive grains 211*a* on the roller portion 211 radially outer surface. The discs are positioned to reflect the profile of a region of small radius or tight tolerance on the tool surface to be dressed.

Figure 11:
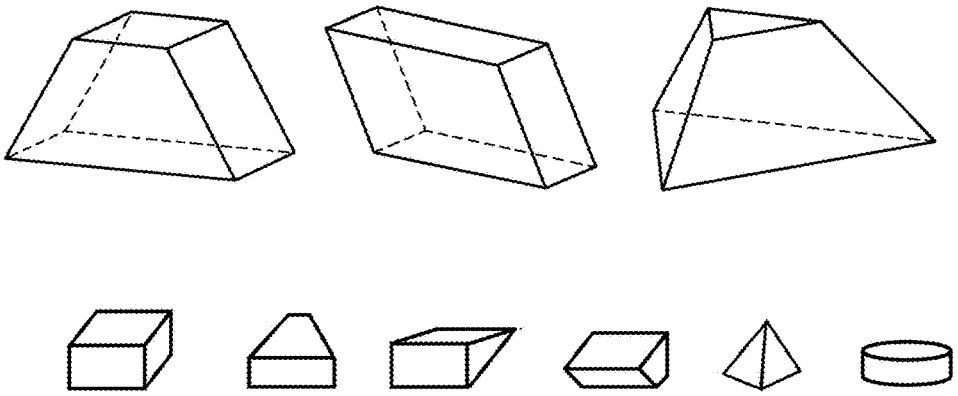
FIG. 11 shows example geometries for abrasive units to be provided on the radially outer surface of discs included in a roller assembly in accordance with the invention.

It will be appreciated that a wide range of abrasive unit geometries is possible using laser ablation. Geometries can be uniform or non-uniform and symmetrical or asymmetrical. Either or both the rake angle ($\gamma$) and clearance angle ($\alpha$) of a given unit geometry can be defined. It is also possible to define a combination of primary and secondary rake angles and primary and secondary clearance angles. Thus, it is also possible to provide a specific geometry for the units, which geometry allows different dressing actions depending on the direction of rotation of the dresser roller assembly. Several possible geometries can be obtained on the abrasive surface, in order to optimize the abrasive action according to the abrasive unit arrangement and the rake angle. FIG. 11 shows some example geometries, other geometries are achievable without departing from the scope of the invention.

Figure 12:
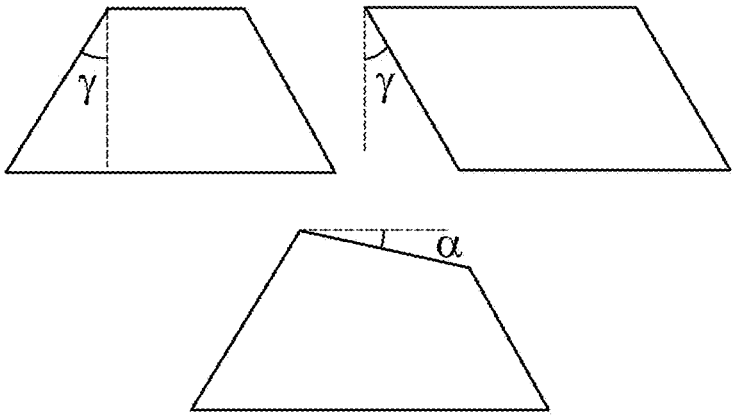
FIG. 12 shows rake ($\gamma$) and clearance ($\alpha$) angles on three example abrasive units having different geometries.

Several values of rake angles (γ) can be obtained through techniques such as laser ablation, further increasing the control of the dresser abrasive action. With reference to FIG. 12, the rake angle can be either positive or negative, for example in the range between −60° and +20°. These values represent just an indication on the achievable range using current laser ablation techniques.

Together with the rake angle, the clearance angle (α) can be varied for a specific abrasive arrangement, allowing for the control of the dressing action in terms of applied pressure between abrasive units in different regions on the dresser abrasive surface. With reference to FIG. 12, it could be possible to vary the clearance angle between 0° and +20° in order to control the amount of pressure on each abrasive unit resulting from the interaction between the grinding wheel and the dressing tool. Thus, the contact pressure can be reduced through increasing the clearance angle and vice versa.

Thanks to the high capabilities of material removal techniques such as laser ablation technique the abrasive surface density range of the novel dressing tool can span between the same values covered by conventional dressers, with the possibility to be further extended. For example, as per conventional diamond form rollers, the density values corresponding to specific diamond size could be summarized in the Table 1.

TABLE 1

Typical diamond sizes and densities for diamond form rolls

| Diamond size | Surface density (carat/cm$^2$) | | |
|---|---|---|---|
| (μm) | Dense | Medium | Sparse |
| 1000/850 | 2.3 | 2.0 | 1.6 |
| 850/710 | 2.1 | 1.8 | 1.5 |
| 710/600 | 1.7 | 1.5 | 1.3 |
| 600/500 | 1.5 | 1.3 | 1.1 |
| 500/425 | 1.2 | 1.0 | 0.8 |
| 425/355 | 0.9 | 0.7 | 0.5 |

In case of conventional dressers, the surface abrasive density is mainly correlated to the grit size. Conversely, in embodiments of the present invention it is possible to set different combinations of abrasive unit shape, size and density, leading to high control of the local abrasive characteristics.

An additional advantage of using the laser ablation technique to realize the abrasive unit patterns and geometries on the dresser abrasive surface is that, unlike handset dressers, very small abrasive units (for example <100 μm) can be arranged with specific patterns, removing the limitation on the minimum abrasive size currently related to some prior art dressers.

It will be appreciated, for dressers characterized by complex profiles the speed ratio value is not uniform and varies as a function of the profile radius. In order to compensate for this variation, it is possible to act on both the abrasive unit size and surface density. Increasing the number of abrasive units per unit area (surface density), or decreasing the mean size of the abrasive units will correspond to lower values of the grinding wheel surface roughness. Thus, in case of higher values of the speed ratio, the dresser wear rate can be decreased, thanks to the increasing of the surface density.

Figure 14:
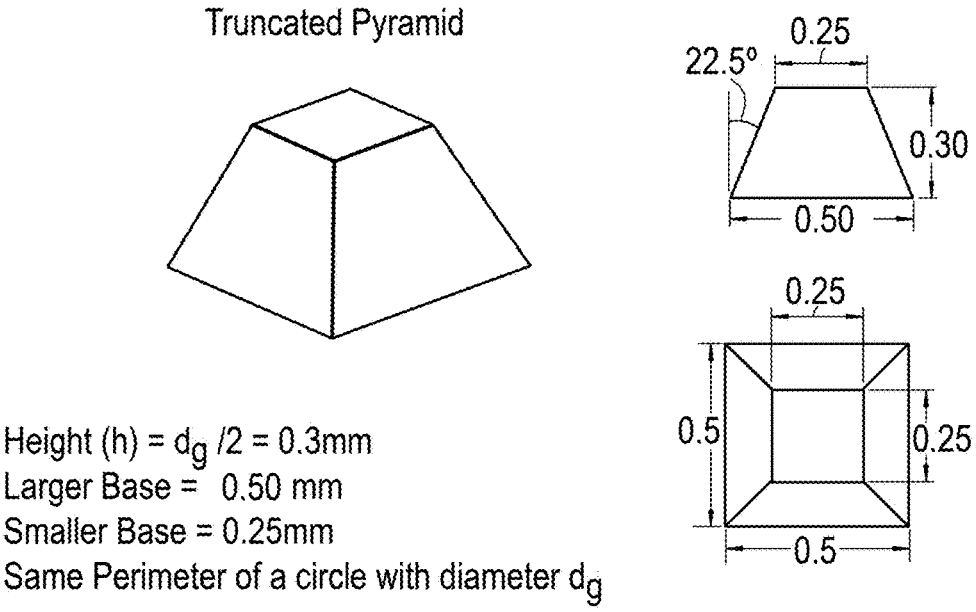
FIG. 14 shows in detail the geometry and dimensions of one example of an abrasive unit suited to use in some embodiments of a roller assembly in accordance with the invention.

The lower limit on the abrasive density can be imposed in consideration of the assumed grain shape and size. Further explanation is given with reference to FIG. 14. The figure shows an abrasive unit of truncated pyramid shape, with the dimensions indicated in the figure.

The dimensions shown in the figure correspond to an average diameter of 0.6 mm for ideal spherical shape grit, utilizing a correlation based on the base perimeter equality and on the assumption that the ideal abrasive unit possesses a protrusion height equal to half of the diameter.

In this example the maximum surface density can be calculated to be approximately equal to 0.8 carat/cm$^2$. However, as previously discussed, it can be advantageous to allow greater space between the unit bases to allow a suitable flow of machined material and//or the passage of a coolant. Nevertheless, grains with smaller size can be packed in a denser configuration.

Figure 13:
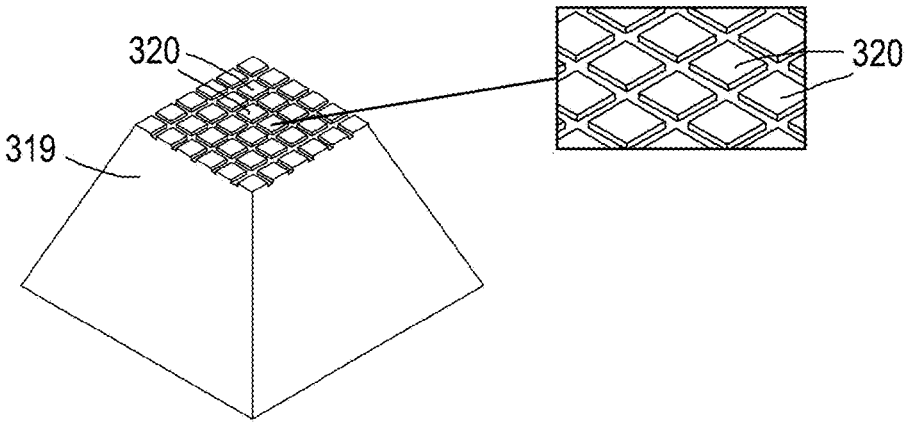
FIG. 13 shows in detail the surface of an abrasive unit for use in some embodiments of the invention.

FIG. 13 shows a further optional and potentially beneficial feature achievable using the described techniques. As can be seen, a single abrasive unit 319 is provided with a surface pattern of much smaller abrasive units 320. Such an arrangement can result in a further increase in the surface abrasive action.

As already stated, using laser ablation (and similar) techniques, the geometries and pattern arrangements of the abrasive units can be designed to suit the specific wheel dressing application, providing the possibility of a wide range of patterns or combinations of patterns (e.g. ordered, staggered, wave) having features that are either uniformly distributed across the entire radially outer surface, or having regions of differing populations of units depending on factors such as the duty cycle and accuracy requirements of the dresser. In addition, the pattern of the abrasive units can be designed to allow an optimal debris flow during the dressing process.

The skilled person will appreciate that the novel abrasive pattern configurations described herein are applicable not only to the roller assemblies and dressing rolls described in detail, but also to single disc arrangements (with a single ring of abrasive units on a dis or roller periphery) and also to fixed dressing tools including, but without limitation, blade tools, single point diamond and multipoint diamond dressing sticks.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A roller assembly for a rotary dresser comprising a plurality of discs, each disc provided with a radially outer surface that is abrasive, the plurality of discs secured in axial alignment, each in a preconfigured rotational orientation and a centrally arranged aperture for receiving a rotor shaft and wherein the radially outer surface of one or more discs has been subjected to a process of material removal whereby to form a pre-defined pattern of individual abrasive units, wherein the plurality of discs comprising discs having different outer diameters, and the plurality of discs are arranged with discs having outer diameters that are the largest positioned in a middle of the roller assembly and are arranged such that diameters of subsequent discs are smaller from the middle of the roller assembly to each axial end of the roller assembly.

2. A roller assembly as claimed in claim 1 wherein one or more of the discs are composed from multiple disc segments.

3. A roller assembly as claimed in claim 1 wherein the radially outer surface of each disc has been processed using an energy beam ablation technique to remove material from an evenly distributed layer of abrasive material whereby to provide individually formed abrasive units.

4. A roller assembly as claimed in claim 3 wherein the abrasive material is polycrystalline diamond (PCD).

5. A roller assembly as claimed in claim 1 wherein the geometry of the abrasive units includes at least a primary rake angle (γ) and a primary clearance angle (α).

6. A roller assembly as claimed in claim 5 wherein the geometry of the abrasive units further includes a secondary rake angle and a secondary clearance angle different from the primary rake angle (γ) and primary clearance angle (α).

7. A roller assembly as claimed in claim 1 wherein not all the discs share the same population density of abrasive units on their radially outer surface.

8. A roller assembly as claimed in claim 1 further comprising a hub received in a common bore of the plurality of discs, first and second flanges arranged on opposite axially facing surfaces of the plurality of discs, an arrangement of tapped holes extending through each flange and into the hub and an arrangement of fasteners securely received in the tapped holes, whereby to hold the discs, flanges and hub in axial and rotational alignment.

9. A roller assembly as claimed in claim 8 wherein one or more of the discs comprise of multiple segments which are arcuate, each of the multiple segments having an axially facing surface, a radially outer surface and a pair of symmetrically arranged holes passing therethrough, recesses are provided in one or both of the flanges in alignment with the holes and locking pins are located in the aligned holes and recesses.

10. A roller assembly as claimed in claim 8 mounted on a rotor shaft between axially aligned spacers and rotationally and axially locked in position by means of a locking nut.

11. A roller assembly as claimed in claim 1 wherein the geometry of the abrasive units is not consistent between all discs.

12. A roller assembly as claimed in claim 1 comprising a radially outer surface presenting an array of abrasive units arranged in a pre-defined pattern, wherein the pattern is configured to provide flow channels between abrasive units across the radially outer surface.

13. A roller assembly as claimed in claim 1 wherein a radially outwardly facing surface of one or more abrasive units is provided with a pattern of micro abrasive units of substantially smaller proportions than the abrasive units.

14. A roller assembly as claimed in claim 1 wherein a difference between outer diameters of adjacent discs is less for discs positioned at ends of the roller assembly than for discs positioned toward the middle of the roller assembly.

15. A roller assembly for a rotary dresser comprising a plurality of discs, each disc provided with a radially outer surface that is abrasive, the discs secured in axial alignment, each in a preconfigured rotational orientation and a centrally arranged aperture for receiving a rotor shaft and wherein the radially outer surface of two or more discs has been subjected to a process of material removal whereby to form a pre-defined pattern of individual abrasive units, wherein each of the individual abrasive units, which are located on a first disc of the plurality of discs, include a first geometry, and each of the individual abrasive units, which are located on a second disc of the plurality of discs, include a second geometry that is different than the first geometry.

16. A roller assembly as claimed in claim 15 wherein the radially outer surface of each disc has been processed using an energy beam ablation technique to remove material from an evenly distributed layer of abrasive material whereby to provide individually formed abrasive units.

17. A roller assembly as claimed in claim 15 wherein the geometry of the abrasive units includes at least a primary rake angle (γ) and a primary clearance angle (α).

18. A roller assembly as claimed in claim 17 wherein the geometry of the abrasive units further includes a secondary rake angle and a secondary clearance angle different from the primary rake angle (γ) and primary clearance angle (α).

19. A roller assembly as claimed in claim 15 wherein one or more of the discs are composed from multiple disc segments, the roller assembly further comprising a hub received in a common bore of the plurality of discs, first and second flanges arranged on opposite axially facing surfaces of the plurality of discs, an arrangement of tapped holes extending through each flange and into the hub and an arrangement of fasteners securely received in the tapped holes, whereby to hold the discs, flanges and hub in axial and rotational alignment.

20. A roller assembly as claimed in claim 19 wherein one or more of the discs comprise of multiple segments which are arcuate, each having an axially facing surface, a radially outer surface and a pair of symmetrically arranged holes passing therethrough, recesses are provided in one or both of the flanges in alignment with the holes and locking pins are located in the aligned holes and recesses.

21. A roller assembly as claimed in claim 15 wherein not all the discs share the same population density of abrasive units on their radially outer surface.

22. A roller assembly as claimed in claim 15 comprising a radially outer surface presenting an array of abrasive units arranged in a pre-defined pattern, wherein the pattern is configured to provide flow channels between abrasive units across the radially outer surface.

23. A roller assembly as claimed in claim 15 wherein a radially outwardly facing surface of one or more abrasive units is provided with a pattern of micro abrasive units of substantially smaller proportions than the abrasive units.

24. A roller assembly as claimed in claim 15 wherein the discs are provided in a range of diameters and are arranged in a pre-defined order to provide a pre-defined, non-linear circumferential profile of the roller assembly.

* * * * *